US009725896B2

(12) United States Patent
Hirata et al.

(10) Patent No.: US 9,725,896 B2
(45) Date of Patent: Aug. 8, 2017

(54) FRAMING HARDWARE

(71) Applicant: NICE HOLDINGS, INC., Kanagawa (JP)

(72) Inventors: Koichiro Hirata, Kanagawa (JP); Syunsuke Hara, Kanagawa (JP)

(73) Assignee: NICE HOLDINGS, INC., Kanagawa (JP)

( * ) Notice: Subject to any disclaimer, the term of this patent is extended or adjusted under 35 U.S.C. 154(b) by 0 days.

(21) Appl. No.: 14/892,454

(22) PCT Filed: Apr. 16, 2015

(86) PCT No.: PCT/JP2015/061680

§ 371 (c)(1),
(2) Date: Nov. 19, 2015

(87) PCT Pub. No.: WO2016/024418

PCT Pub. Date: Feb. 18, 2016

(65) Prior Publication Data

US 2016/0305112 A1 Oct. 20, 2016

(51) Int. Cl.
*E04B 1/38* (2006.01)
*E04B 1/26* (2006.01)
(Continued)

(52) U.S. Cl.
CPC ..... *E04B 1/38* (2013.01); *E04B 1/26* (2013.01); *E04B 1/58* (2013.01); *E04C 3/12* (2013.01)

(58) Field of Classification Search
CPC ..... E04B 1/38; E04C 3/12
See application file for complete search history.

(56) References Cited

U.S. PATENT DOCUMENTS 2,079,478 A * 5/1937 Bashe ..... E04B 1/4128 52/702
5,483,780 A 1/1996 Stumpf
(Continued)

FOREIGN PATENT DOCUMENTS

JP 2004257125 A * 9/2004
JP 2005127007 A * 5/2005
(Continued)

OTHER PUBLICATIONS

International Search Report and Written Opinion dated Jun. 9, 2015 in corresponding Japanese International Application No. PCT/JP2015/061680, filed Apr. 16, 2015.
(Continued)

*Primary Examiner* — Jeanette E Chapman
(74) *Attorney, Agent, or Firm* — McDermott Will & Emery LLP

(57) ABSTRACT

A shaft member having an engaging part at a lower part is formed to project from a front edge part of a plate-like fitting main body having a required thickness, and an engaging member having an engaging part at a lower part is mounted to a tip surface of the shaft member, the engaging parts communicating with each other, wherein the fitting main body has a gripping part formed of a through-hole at a central part and pin insertion parts which are formed collinearly in the vicinity of an upper edge part and a lower edge part at a rear side of the fitting main body, and wherein a shaft-member insertion part resisting shear stress is provided at a portion different from the pin insertion parts formed on the upper edge part and the lower edge part.

5 Claims, 4 Drawing Sheets

(51) Int. Cl.
*E04B 1/58* (2006.01)
*E04C 3/12* (2006.01)

(56) References Cited

U.S. PATENT DOCUMENTS

| | | | | |
|---|---|---|---|---|
| 8,607,515 | B2 * | 12/2013 | Jarvis | E04B 1/0038 403/258 |
| 8,950,133 | B2 * | 2/2015 | Hansort | E04B 1/215 52/283 |
| 2008/0279620 | A1 * | 11/2008 | Berg | E04B 1/215 403/178 |
| 2013/0028657 | A1 * | 1/2013 | Kenho | E04B 1/2604 403/188 |
| 2014/0318059 | A1 * | 10/2014 | Hansort | E04B 1/215 52/283 |

FOREIGN PATENT DOCUMENTS

| | | | | | |
|---|---|---|---|---|---|
| JP | 2005155164 | A | * | 6/2005 | |
| JP | 2005180043 | A | * | 7/2005 | |
| JP | 3996343 | B2 | | 10/2007 | |
| JP | 2009209641 | A | * | 9/2009 | |
| JP | 2012097402 | A | * | 5/2012 | |
| JP | 2013096197 | A | * | 5/2013 | |
| JP | 2013133676 | A | * | 7/2013 | |
| JP | 2014-070438 | A | | 4/2014 | |
| JP | 2014218778 | A | | 11/2014 | |
| JP | 5692836 | B1 | | 4/2015 | |
| NO | DK-169357 | B1 | * | 10/1994 | E04B 1/215 |

OTHER PUBLICATIONS

Patent Examination Report issued Aug. 3, 2016, in corresponding Australian Patent Application No. 2015255291.

* cited by examiner

FRAMING HARDWARE

CROSS-REFERENCE

This application is the U.S. National Phase under 35 U.S.C. §371 of International Application No. PCT/JP2015/061680, filed Apr. 16, 2015, the entire content is hereby incorporated by reference.

TECHNICAL FIELD

The present invention relates to framing hardware which is for use in wooden buildings, such as detached houses, and which can cope with shear fracture exerted on the framing hardware.

BACKGROUND ART

An example of the framing hardware for use in wooden buildings is disclosed in Japanese Patent No. 3996343 (Patent Document 1). Patent Document 1 discloses a building framework structure having a columnar receiving member and a beam-like crossing member, which cross each other to be fixed for framing, and a framing hook provided between both members for engaging and fixing them, and having an engaging hook engaging the framing hook itself with the receiving member with the receiving member side by insertion and engaging to the receiving member and a receiving hook being projected from the framing surface of the receiving member under the engaged state to receive and retain the butt end side of the crossing member. The structure has a reinforcing connector inserted into the receiving member and conducting a traction action so as to compensate for a support reactive force from the opposite side of the framing surface of the receiving member at a time when the receiving hook receives the crossing member by engaging its insertion end side disengageably with the engaging hook in receiving member, and the reinforcing connector is a rod-like pin. The engaging part engaged by the engaging hook is a groove-like engaging part provided in the peripheral surface of an end of the pin, for housing and engaging the engaging hook.

CITATION LIST

Patent Literature

Patent Document 1: Japanese Patent No. 3996343 (claim 1, FIGS. 3 to 4)

SUMMARY OF INVENTION

Technical Problem

The framework tool (framing hardware) disclosed in Patent Document 1 is made of a molding of lightweight metal having high-strength, such as an aluminum alloy, or synthetic resin, such as fiber-reinforced plastic (FRP), and consists of a plate-like receiving hook, an engaging hook, and a key part integrally provided between both hooks.

The receiving hook has, in the upper tip position, a V-shaped engaging groove whose tip side inner surface is inclined and whose bottom is formed in a curved shape (R shape) which coincides with the peripheral surface of the pin, and the lower part of the receiving hook, which is disposed at the lower position of the engaging groove, is pierced with a pin hole in which the pin is inserted and fitted, similarly.

In other words, the framework tool has a holding part consisting of a through-hole formed at a part for facilitating carrying, a pin holding part formed by cutting out the upper edge of the rear part of the plate-like receiving hook downward into a U shape, and a pin hole formed in the peripheral edge of the bottom directly under the pin holding part so as to be positioned on the same line as the pin holding part.

In the receiving hook, the outer periphery forms a slightly thick plate-like peripheral edge part, the inside thereof is formed in a thin rib shape, and a holding hole for pass through a finger is formed close to the base end so as to be easy to hold it with a finger, and thereby reduction of the weight can be achieved as a whole, and the strength of the hook is kept by providing a predetermined thickness to only the peripheral edge. However, shear fracture acting on the receiving hook is not taken into account at all.

Therefore, shear deformation in the receiving hook can easily damage the receiving hook, thus there is a possibility that the effects of the receiving hook may not be produced.

In view of such circumstances, the present invention aims to provide framing hardware capable of absorbing a load due to shear deformation that acts on a beam when the beam is connected to a pillar of a wooden building using well-known framing hardware.

Solution to Problem

To achieve the above object, framing hardware according to the present invention is characterized in that a shaft member having an engaging part at a lower part is formed to project from a front edge part of a plate-like fitting main body having a required thickness, and an engaging member having an engaging part at a lower part is mounted to a tip surface of the shaft member, the engaging parts mutually communicating with each other, wherein the fitting main body has a gripping part formed of a through-hole at a central part and insertion parts for inserting a pin, which are formed collinearly in the vicinity of an upper edge part and a lower edge part at a rear side of the fitting main body, and wherein a shaft-member insertion part resisting shear stress is provided at a portion different from the insertion parts for inserting a pin, which are formed in the vicinity of the upper edge part and the lower edge part.

The invention according to claim 2 of the present invention, in the framing hardware according to claim 1, is characterized in that the shaft-member insertion part is located in the vicinity of a rear edge part of the gripping part.

The invention according to claim 3 of the present invention, in the framing hardware according to claim 1 or 2, is characterized in that an opening of the shaft-member insertion part opens on a same surface as a surface of the fitting main body.

Advantageous Effects of Invention

In using the framing hardware according to the present invention by mounting the fitting main body constituting the bearing hardware (framing hardware) to a beam-like crossing member, the framing hardware has an insertion hole for a third shaft member at a position different from the positions in which the pair of upper and lower insertion holes for inserting a pin, which are provided to the rear edge side of the fitting main body, are formed.

Thus, even if a crossing member to which the fitting main body is mounted is subjected to shearing force for some reason, so that the fitting main body is subjected to shear stress, there is no possibility that the fitting main body will be damaged, thus increasing the drawing strength between the pillar and the beam.

This allows the crossing member to be reliably held to a proper position of a receiving member at all times.

DESCRIPTION OF EMBODIMENTS

Figure 1:
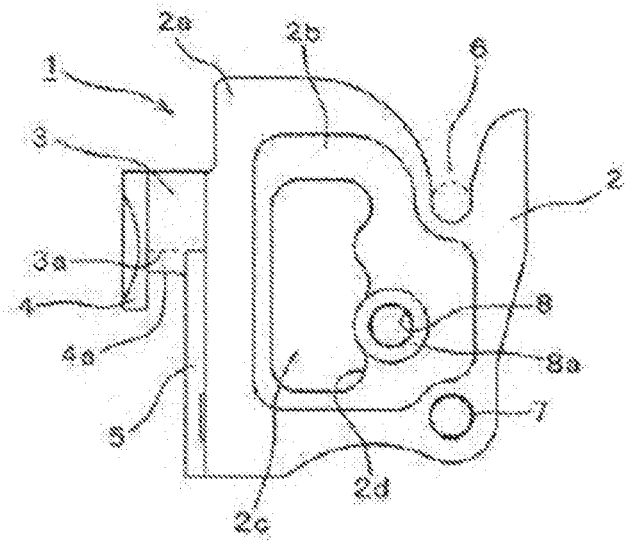
FIG. 1 is a front view of a bearing hardware (framing hardware) according to an embodiment of the present invention.
Figure 2:
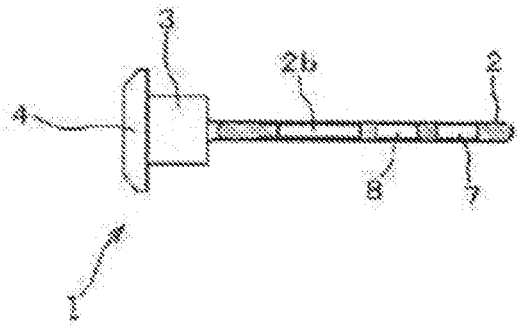
FIG. 2 is a partly cut-out plan view of main components of the framing hardware shown in FIG. 1.
Figure 3:
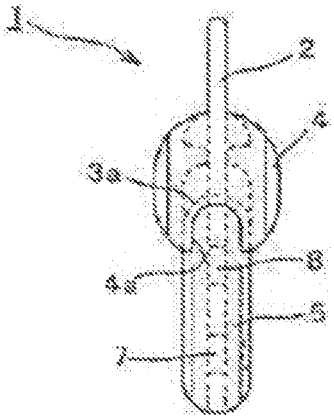
FIG. 3 is a side view of the framing hardware shown in FIG. 1.

A framing hardware according to an embodiment of the present invention will be described hereinbelow with reference to the drawings.

It is to be understood that the present invention is not limited to only the embodiment described below and that modifications can freely be made without departing from the spirit of the present invention.

A framing hardware 1 according to the present invention is constituted such that a columnar shaft member 3 is integrally formed to project on a position at a required interval from an upper end of the front edge part of a fitting main body 2 having a required thickness, a central part of the back of a plate-like elliptic engaging member 4 is located at a tip part of the shaft member 3, and a central part of the back of an elliptic key member 5 is located at the front edge part below the engaging member 4.

When the framing hardware 1 is acted upon by a downward load, the key member 5 holds the framing hardware 1 at a predetermined position by coming into contact with a void 11 of a pillar 9, described later.

The shaft member 3 and the engaging member 4 coaxially have engaging parts 3*a* and 4*a*, respectively, at their lower parts, which engage with a ring-shaped engaging groove 13*b* provided in the vicinity of a tip part of a fixing member 13, described later.

The fitting main body 2 has a pin insertion portion 6 for supporting a fixing pin 6*a* which is formed by forming a U-shaped cut portion at the upper edge of the rear part thereof, and a pin insertion part 7 inserting a fixing pin 7*a*, which is also formed on a lower part of the fitting main body 2 positioned on the same line below the pin insertion part 6.

In this case, the fitting main body 2 has a thin wall part 2*b* which is formed on the central part leaving a peripheral edge part 2*a*, a through-hole 2*c* with a required size which is formed on the thin wall part 2*b*, and a wavy gripping part 2*d* for engagement-fitting a fingertip which is formed along a rear edge part of the through-hole 2*c*.

Forming the thin wall part 2*b* allows the weight of the fitting main body 2 to be reduced.

The wavy gripping part 2*d* formed on the rear edge part of the through-hole 2*c* partly has a support-shaft insertion hole 8, in the vicinity of the gripping part 2*d*, which is formed for inserting a support shaft 8*a* having a diameter larger than those of the fixing pins 6*a* and 7*a*.

An opening peripheral edge part 8*a* of the support-shaft insertion hole 8 has the same height as that of the peripheral edge part 2*a* of the fitting main body 2.

It is thus possible to increase the strength of the support-shaft insertion hole 8, and it is possible to reliably prevent shear deformation in the fitting main body 2 by inserting the support shaft 8*a* having a diameter larger than those of the pins, which are inserted into the pin insertion part 6 and the pin insertion part 7, into the support-shaft insertion hole 8.

Furthermore, it is possible to increase a drawing strength between the pillar and a beam.

Figure 4:
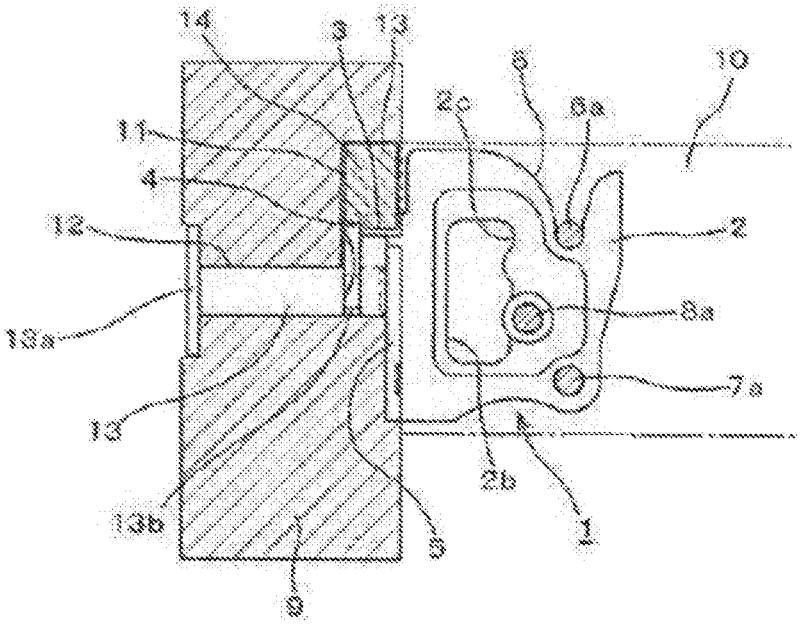
FIG. 4 is a front view of the framing hardware shown in FIG. 1, showing an example of the use state.

As shown in FIG. 4, the thus-constituted framing hardware 1 is constituted such that the void 11 for receiving the shaft member 3, the engaging member 4, and the key member 5, which are projected from the front edge part of the fitting main body 2, is formed in a part on which the beam member 10 as a crossing member is mounted in the pillar member 9 as a receiving member in such a manner that at least the height is more than that of the engaging member 4.

When the fitting main body 2 is acted upon by a downward load, the key member 5 holds the fitting main body 2 at a predetermined part with friction due to contact pressure between the key member 5 and the pillar member 9.

The beam member 10 has a slit (not shown) formed for mounting the fitting main body 2 at the central part of an end face opposing the pillar member 9. The fitting main body 2 except the shaft member 3, the engaging member 4, and the key member 5 provided at the front edge part is inserted into the slit, and the pins 6*a* and 7*a* are inserted from a side into the pin insertion part 6 and the pin insertion part 7, thereby fixing the beam member 10.

On the other hand, in the pillar member 9, an insertion part 12 communicating with a lower part of the void 11 is formed from a part (back) opposite to a mounting part (front) of the beam member 10. A tip part of the fixing member 13 constituted of a shaft member is inserted from a base end of the insertion part 12.

The fixing member 13 inserted into the pillar member 9 is constituted to express the ring-shaped engaging groove 13*b* formed on the tip part of the fixing member 13 at the bottom of the void 11, in a state that a plate-like engaging part 13*a* formed on the base end is fixed to an engaging part provided on the backside of the pillar member 9.

Next, the engaging portion 4*a* of the engaging member 4 and the engaging portion 3*a* of the shaft member 3, which are provided at the front edge part of the fitting main body 2, are fitted into the engaging groove 13*b* expressed in the void 11, and a spacer 14 made of an elastic material is fitted into the void 11 left above the shaft member 3 and the engaging member 4 to fix the fitting main body 2 to the front part of the pillar member 9.

Figure 6:
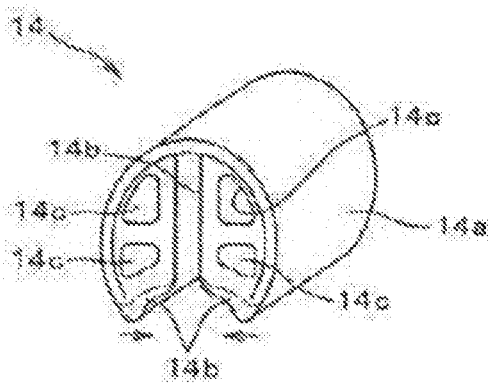
FIG. 6 is a perspective view of a spacer for use in using the framing hardware according to the present invention.

As shown in FIG. 6, the spacer 14 is made of an elastic resin material in which a pair of side walls 14*b* and 14*b* extending downward from an upper surface are integrally formed at a required interval at the central part of an elliptic spacer main body 14*a* that is open at the lower part, and their lower ends are connected to the lower end of the spacer main body 14*a*.

Figure 7:
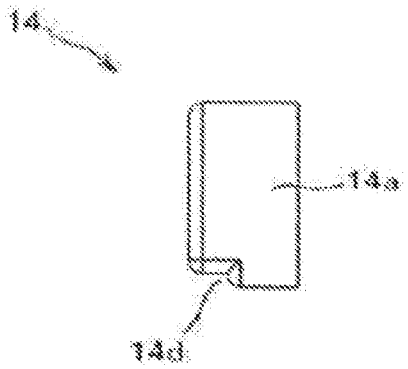
FIG. 7 is a side view of the spacer shown in FIG. 6.

As shown in FIG. 7, the spacer main body 14 has a notch (cutout) part 14*d* at a lower front edge part which is formed for avoiding contact with the upper edge part of the engaging member 4 formed on the fitting main body 2 when used.

Therefore, when the spacer 14 is acted upon by a load at mounting, both of the right and left side walls 14*b* and 14*b* move inward to change in shape, thus absorbing the load.

Figure 8:
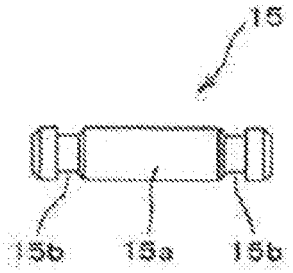
FIG. 8 is a front view of another shaft member for use in using the framing hardware according to the present invention.

The fixing member 13 has the disk-like engaging part 13*a* at the base end and the ring-shaped engaging groove 13*b* at the tip side. Depending on the application, a fixing member 15, as shown in FIG. 8, may be used.

This fixing member 15 has ring-shaped engaging grooves 15*b* and 15*b* at both ends of a shaft main body 15*a*.

Figure 5:
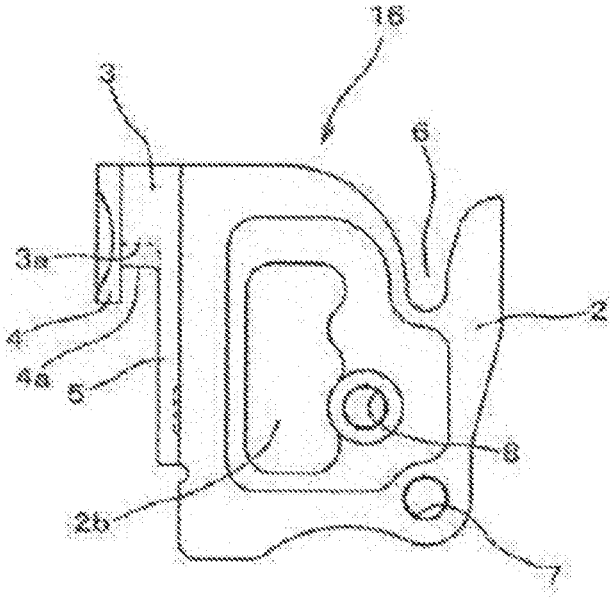
FIG. 5 is a front view of a framing hardware according to another embodiment of the present invention.

A framing hardware 16 shown in FIG. 5 is another example according to the present invention, in which the same component is denoted by the same sign, and the position of the shaft member 3, which is formed to project from a front edge part of the fitting main body 2, is located at the upper end of the front edge part.

The reason is to avoid a situation in which, when a beam member is to be mounted to three (or four) surfaces of a pillar member by using a plurality of fixing members although not illustrated, the fixing members for fixing individual framing hardwares cannot be crossed at the central part, so that the mounting cannot be performed.

Although the support shaft 8 used in this embodiment is thicker in diameter than the fixing pin 6*a* or 7*a*, even the same diameter allows a load due to shear deformation to be absorbed.

In particular, the present invention increases the strength by not disposing the shaft member for absorbing the load due to shear deformation collinearly with the pins 6*a* and 7*a* for fixing the fitting main body 2 to the beam member 10.

Accordingly, using two pins and three pins properly depending on required strength can increase the economic efficiency and reduce the kind of pin to be used, thereby improving workability in the building site.

Furthermore, performing processing of pins in timber only on necessary portions eliminates a mistake in the number of pins used.

INDUSTRIAL APPLICABILITY

Since the framing hardware according to the present invention can prevent shear deformation by absorbing a shear stress exerted on the fitting main body in addition to the insertion hole of pins for mounting the fitting main body to a beam member or the like, applications of the framing hardware can be increased.

EXPLANATION OF SIGNS

1 BEARING HARDWARE (FRAMING HARDWARE)
2 FITTING MAIN BODY
2*a* PERIPHERAL EDGE PART
2*b* THIN WALL PART
2*c* THROUGH-HOLE
2*d* GRIPPING PART
3 SHAFT MEMBER
3*a* ENGAGING PART
4 ENGAGING MEMBER
4*a* ENGAGING PART
5 KEY MEMBER
6, 7 PIN INSERTION PART
8 INSERTION PART
8*a* PERIPHERAL EDGE PART OF INSERTION PART
9 PILLAR MEMBER
10 BEAM MEMBER
11 VOID
12 INSERTION PART
13 FIXING MEMBER
14 SPACER
15 FIXING MEMBER

The invention claimed is:

1. Framing hardware, wherein a shaft member having an engaging part at a lower part is formed to project from a front edge part of a plate-like fitting main body having a required thickness, and an engaging member having an engaging part at a lower part is mounted to a tip surface of the shaft member, the engaging parts mutually communicating with each other, the engaging part of the engaging member being configured to engage with a ring-shaped engaging groove provided in the vicinity of a tip part of a fixing member, wherein the fitting main body has a gripping part formed of a through-hole at a central part and insertion parts for inserting a pin, which are formed collinearly in the vicinity of an upper edge part and a lower edge part at a rear side of the fitting main body, and wherein a shaft-member insertion part resisting shear stress is provided at a portion different from the insertion parts for inserting a pin, which are formed in the vicinity of the upper edge part and the lower edge part, wherein the shaft member and the pins are non-collinearly disposed.

2. The framing hardware according to claim 1, wherein the shaft-member insertion part is located in the vicinity of a rear edge part of the gripping part.

3. The framing hardware according to claim 1, wherein an opening of the shaft-member insertion part opens on a same surface as a surface of the fitting main body.

4. The framing hardware according to claim 2, wherein an opening of the shaft-member insertion part opens on a same surface as a surface of the fitting main body.

5. The framing hardware according to claim 1, wherein the fitting main body has a thin wall part which is formed on the central part leaving a peripheral edge part.

* * * * *